US005824976A

United States Patent [19]

Jamieson et al.

[11] Patent Number: 5,824,976

[45] Date of Patent: Oct. 20, 1998

[54] METHOD AND APPARATUS FOR SENSING FAULT CONDITIONS FOR AN ELEVATOR ACTIVE ROLLER GUIDE

[75] Inventors: Eric K. Jamieson, Farmington; Daniel S. Williams, Meriden, both of Conn.

[73] Assignee: Otis Elevator Company, Farmington, Conn.

[21] Appl. No.: 805,833

[22] Filed: Mar. 3, 1997

[51] Int. Cl.[6] ..... B66B 1/34; B66B 7/04

[52] U.S. Cl. ..... 187/393; 187/409; 187/292

[58] Field of Search ..... 187/409, 393, 187/394, 391, 292, 278

[56] References Cited

U.S. PATENT DOCUMENTS

| | | | |
|---|---|---|---|
| 4,754,849 | 7/1988 | Ando | 187/95 |
| 5,092,625 | 3/1992 | Kawanata | 280/707 |
| 5,117,946 | 6/1992 | Traktovenko et al. | 187/95 |
| 5,373,123 | 12/1994 | Skalski | 187/393 |
| 5,617,023 | 4/1997 | Skalski | 324/207.17 |
| 5,652,414 | 7/1997 | Roberts et al. | 187/292 |
| 5,703,424 | 12/1997 | Dorman | 310/90.5 |

FOREIGN PATENT DOCUMENTS

| | | | |
|---|---|---|---|
| 467673 | 1/1992 | European Pat. Off. | B66B 11/02 |

*Primary Examiner*—Robert Nappi

[57] ABSTRACT

A fault sensor to be used with a controller as part of an active roller guide (ARG), the fault sensor disabling the ARG if it determines that any pair of current-force magnitudes for any of the ARG actuators is outside of a predetermined acceptable operating envelope, indicating an anomalous, or fault, condition. The ARG fault sensor receives, periodically, magnitudes of current and flux density for each actuator. From these, it calculates an actuator force and then checks that the current-force pair for each actuator is within the operating envelope. This envelope is curvilinear in its boundary. To check the curved segments of the envelope boundary, the fault sensor calculates the gap for each actuator. If each gap magnitude is within range, all that is left is to check the straight segments of the envelope boundary. This is done by simply checking that each actuator current and force magnitude is less than a predetermined limit.

4 Claims, 4 Drawing Sheets

METHOD AND APPARATUS FOR SENSING FAULT CONDITIONS FOR AN ELEVATOR ACTIVE ROLLER GUIDE

BACKGROUND OF THE INVENTION

1. Technical Field

The present invention pertains to the field of active roller guide controllers for elevators. More particularly, the present invention pertains to a method for sensing fault conditions in an elevator active roller guide.

2. Description of Related Art

One type of active roller guide (ARG) uses actuable springs (unparallel) with an electromagnet actuator having an airgap with electromagnetic flux therein. The square of the flux density in the airgap is directly related to the pressure, and hence the force exerted by the electromagnet actuator by the magnetization thereof.

Recent work on the development of active roller guides has focused on having components perform multiple functions, thus reducing the number of components needed. An example of multiple use is the use of output from a flux sensor to determine both position information as well as the flux force generated by actuators of the ARG. See, e.g. FIG. 20 of U.S. Pat. No. 5,294,757 described at column 18, line 38 et sequitur. In an ARG elevator system, mechanical adjustment of the actuators must be within tight bounds for good control, because erroneous signals may cause the controller of the ARG elevator system to pursue an off-center configuration, which may produce unwanted elevator motion and may cause passenger discomfort. It is a problem with existing ARGs that there presently is no good way to judge whether the boundaries are being properly respected. By using the actuators to provide both control force and position information, however, it is possible to detect immediately whether an ARG controller is receiving credible information, information which it should use to adjust control parameters.

There are several events that could lead to ARG controller inputs that should be ignored. An actuator may have been misaligned by, for example, a buffer strike or safety engagement, or may not have been installed correctly. Besides these particular events that would misalign actuators and so degrade control, there are various other conditions that could occur and lead to erroneous input to the controller, information that should be ignored. What is needed is a simple way of disabling the ARG controller whenever it receives information that is likely to have resulted from a fault condition. (The elevator system would then fall back to a passive roller guide until the fault in the ARG is corrected.)

SUMMARY OF THE INVENTION

It is an object of the present invention to detect abnormal mechanical setup of ARG magnetic actuators, and the existence of any condition leading to abnormal flux indications and abnormal current indications. To meet this object, the present invention continually compares inputs to the ARG controller with an acceptable range of magnitudes of actuator current and actuator force, the actuator force being proportional to the square of the sensed flux density.

The ARG uses a flux sensor, which measures flux density, in the gap between an actuator magnet and a reaction bar. In the present invention, the flux density is converted to a corresponding magnitude of actuator force. Finally, the force-current pair of values is compared with the acceptable operating envelope of these values to determine if an abnormality, or fault, is present, regardless of the cause of the abnormality and regardless of where in the system the fault is located. For example, besides actuator misalignment, an abnormal force-current pair may be caused by a malfunction in the flux and current sensing equipment. Since an ARG may become unstable if it receives erroneous input, and since an instability may lead to passenger discomfort, the ARG control system is disabled when a force-current pair is determined to lie outside a pre-determined acceptable operating envelope.

The method of present invention is a method of fault-sensing for an elevator active roller guide (ARG) having a current-driven force actuator for positioning an elevator car horizontally within a vertical hoistway, the actuator having a magnet with a coil, the magnet spaced a variable magnitude gap from a reaction bar, the reaction bar connected to a roller on a rail extending along the vertical hoistway, the ARG establishing more or less current in the coil in order to draw the elevator car with more or less force closer to the reaction bar for changing the gap, the ARG including a means for measuring flux density in the gap created by the current, and means for signaling the magnitude of current used to drive the actuator and means for signaling the magnitude of flux density in the gap. According to the present invention, the method of fault-sensing includes the steps of:

- sensing a signal indicating a new magnitude of current and a signal indicating a new magnitude of flux density;
- determining from the flux density and the current a magnitude of the gap;
- comparing the magnitude of the gap to a range defined by a maximum and minimum allowed magnitude of the gap, and providing a signal indicating whether the magnitude of the gap is outside the range; and
- determining if the magnitude of the force and the magnitude of the current are each less than a respective limit, and providing a signal corresponding to the determination.

Another aspect of the present invention is as an apparatus for use as part of an ARG controller. The apparatus includes

- an input periodically responsive to flux density and current for the actuator;
- an updatable storage device, e.g. a random access memory (RAM), coupled to the input for storing the flux density and current;
- a first memory, e.g. an electrically programmable read-only memory (EPROM), for storing a procedure used to determine if a fault condition exists, based on the magnitudes of current and flux density;
- a second memory, e.g. an erasable EPROM (EEPROM), for storing an acceptable range of gap magnitudes and maximum allowed magnitudes of current and force, the force determined from the flux density; and
- a signal processor, e.g. a microprocessor, coupled to the updatable storage device, first memory and second memory, that executes the procedure stored in the first memory, using as data the contents of the second memory and the contents of the updatable storage device, for providing a signal indicating whether a fault condition exists, where the program stored in the first memory is based on the above-described method.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

Figure 1:
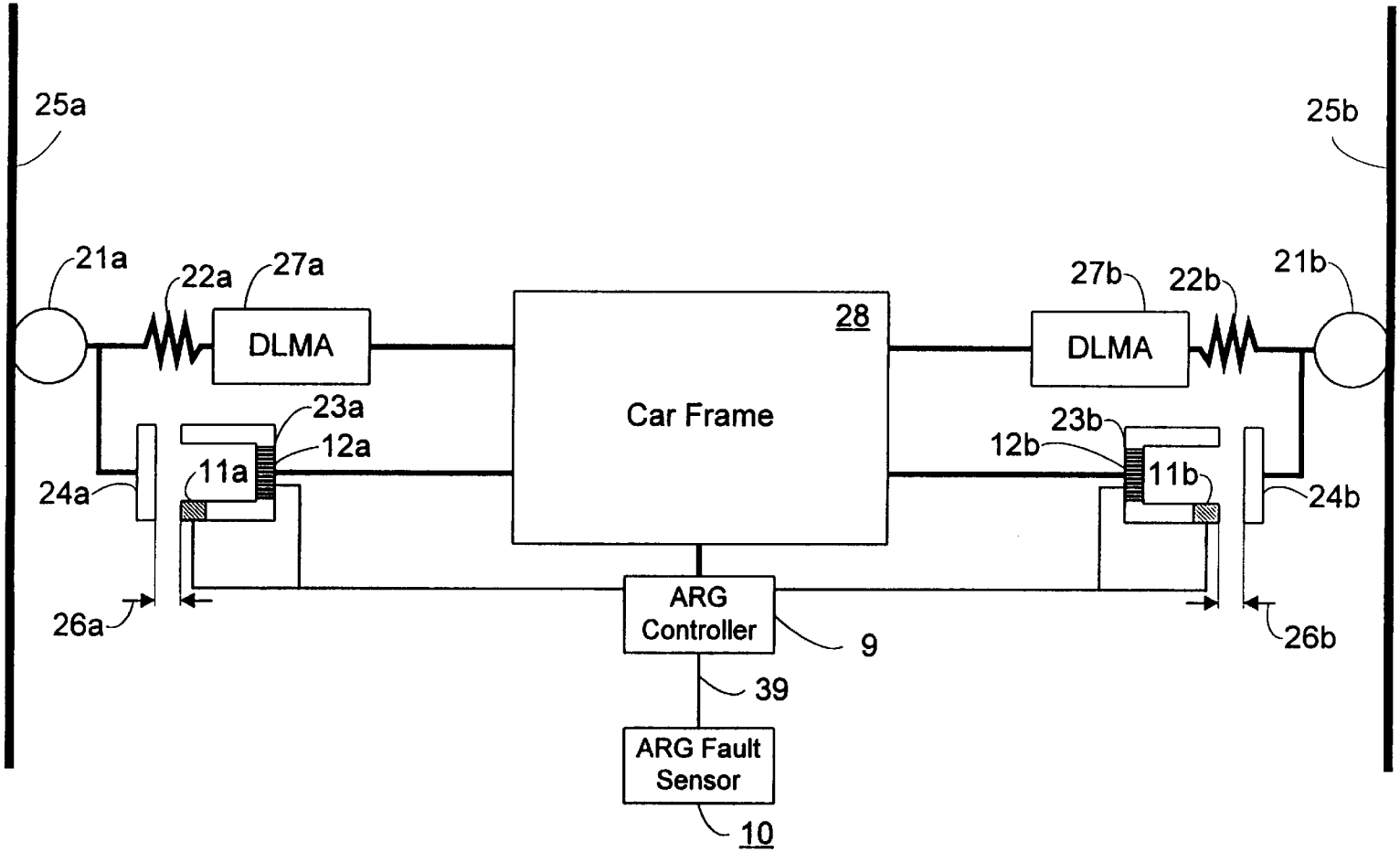
FIG. 1 shows elements of an active roller guide control system for controlling side-to-side motion of an elevator car.

Referring now to FIG. 1, there is shown an active roller guide (ARG) for controlling the side-to-side motion of an elevator car frame 28 between elevator rails 25*a* and 25*b*, the ARG including an ARG fault sensor 10, an element of the ARG controller, according to the present invention, coupled to an ARG controller 9. Besides ARG fault sensor 10 implementing the method of the present invention, the ARG includes, on each side of the car frame 28, a spring 22*a* and 22*b*, an actuator such as but not limited to a digital linear magnetic actuator (DLMA) 27*a* and 27*b* to bias the spring for centering the car horizontally in the hoistway, and a vibration magnet 23*a* and 23*b* having an electrical coil 12*a* and 12*b*, and separated from a reaction bar 24*a* and 24*b* by a gap 26*a* and 26*b*. Finally, on each side of the car frame 28, there are rollers 21*a* and 21*b* on which the car frame 28 rolls along the rails 25*a* and 25*b*. See copending U.S. application Ser. No. 08/741,751 filed Nov. 5, 1006, for an example of a DLMA. Other types of active roller guides are known, e.g., as shown in FIG. 30 of the above-mentioned U.S. Pat. No. 5,294,757.

Each vibration magnet 23*a* and 23*b* is equipped with a flux sensor 11*a* and 11*b* that measures the flux density B in the gap 26*a* and 26*b* between the magnet and the reaction bar 24*a* and 24*b*. The method of the present invention is grounded in the known principle that it is possible to infer information about the gaps 26*a* and 26*b* from the combination of flux density B and actuator current i. This actuator current produces the flux density B. Knowing or sensing the current i, the actuator force F can be calculated directly from the sensed flux density B.

A complete ARG control system for an elevator will include elements for not only side-to-side motion, but also for front-to-back motion on both sides of the elevator. The hardware for these other control axes is similar in principle to the hardware for control of the side-to-side motion.

The actuator current i in a vibration magnet 23*a* or 23*b* produces an actuator force pulling the car frame 28 toward the reaction bar 24*a* or 24*b* according to the formula $$F = \frac{k_f i^2}{g^2} \tag{1}$$

where $k_f$ is a constant for the vibration magnet 23*a* or 23*b* that depends on the area A of the pole faces, and the number of turns of wire on the magnet. The current i produces flux density B, so the actuator force F can also be written in terms of the magnetic flux B as $$F = \frac{B^2}{2\mu_0} A \tag{2}$$

where $\mu_0$ is the permeability of free space. Thus, knowledge of flux density B and the actuator current i in each vibration magnet 23*a* and 23*b* yields both the actuator force F and gap g, since by substituting for F from the equation (2) into equation (1), there results $$g = \left\{ 2\mu_0 \frac{k_f i^2}{AB^2} \right\}^{1/2}. \tag{3}$$

Thus, given a measurement of the flux density B and actuator current i, the control system can determine the actuator force F and gap g, without using a special sensor for gap position.

Figure 2:
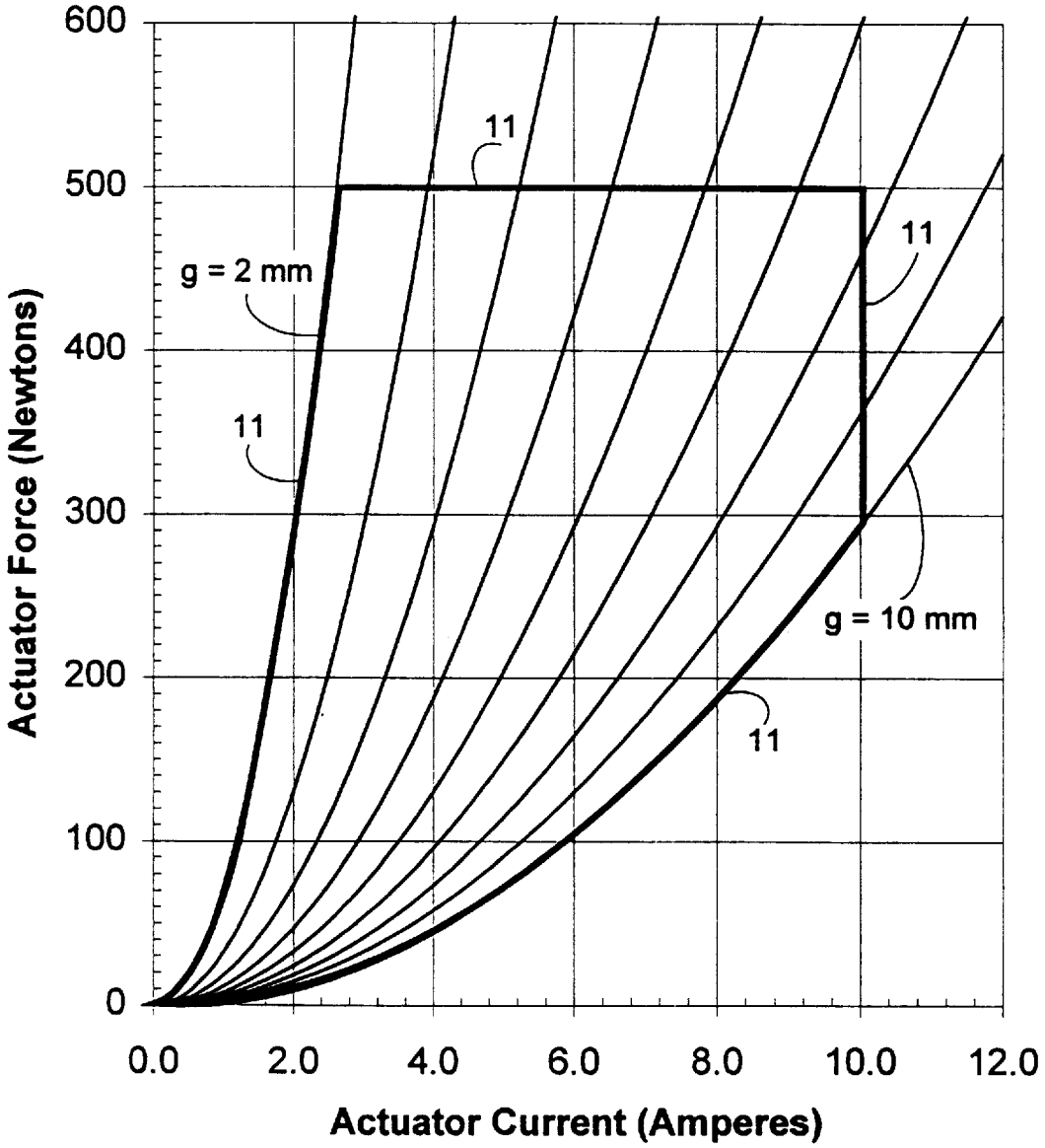
FIG. 2 is a graph of the operating envelope of force-current pairs and illustrates how to determine elevator side-to-side position in terms of a gap between an actuator magnet and a reaction bar, given a force-current pair.

Referring now to FIG. 2, a family of curves of actuator force F corresponding to actuator current i is plotted for discrete gap magnitudes g ranging from 2 mm up to 10 mm, in increments of 1 mm. These curves are based on equation (1) above. Thus, when the flux sensor 11*a* or 11*b* produces a magnitude for the flux density B, the ARG fault sensor 10 will convert that flux density magnitude to an actuator force magnitude F, according to equation (2), and having knowledge of the actuator current i producing that force, the ARG fault sensor 10 can determine the magnitude for the gap g 26*a* or 26*b*, using equation (3). The minimum and maximum allowed gap magnitudes, as e.g. shown in FIG. 2, are pre-stored in a memory. If the gap so determined is acceptable, if it falls between the minimum and maximum allowed magnitudes, the ARG fault sensor 10 will take no action.

For side-to-side motion, as long as the two gaps 26*a* and 26*b* are the same, the elevator is centered. However, each gap should also be within some predetermined acceptable range. When the ARG fault sensor 10 receives the flux density B and current magnitudes i from the ARG controller 9, it will infer, for each side of the elevator car frame 28, a magnitude of the actuator force F, and from that actuator force and the associated current i, using the relationships graphically represented in FIG. 2, it will determine a gap g for each side of the car frame 28. If the two gap magnitudes are the same, then the elevator is centered with respect to side-to-side motion. In addition to being centered though, each gap magnitude must lie within a predetermined acceptable range. In the preferred embodiment, the ARG fault sensor 10 checks that each gap magnitude lies between 2 mm and 10 mm, and further that the magnitude for current i for each actuator be reported to be less than 10 amperes, and that the calculated magnitude of force F be less than 500 Newtons. Thus, the current-force coordinate pair must refer to a point within the region bounded by the curve 11 in FIG. 2. That curve defines the boundary of the pre-determined acceptable operating envelope of magnitudes of actuator current and actuator force.

Figure 3:
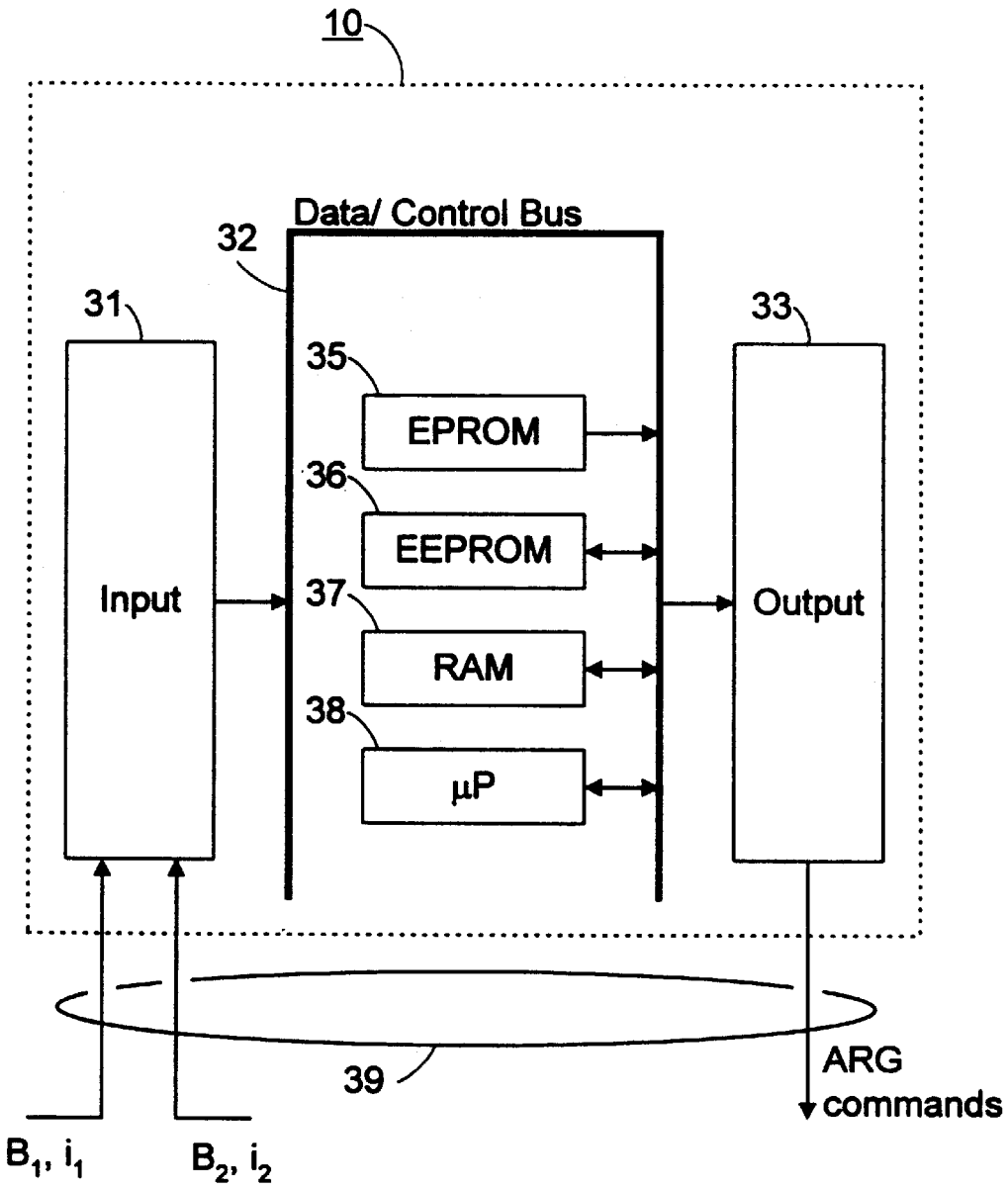
FIG. 3 is a block diagram of a fault sensor for an ARG, according to the present invention.

Referring now to FIG. 3, a block diagram of an implementation of the method of the present invention, ARG fault sensor 10, is shown receiving flux density measurements $B_1$ and $B_2$ and actuator current magnitudes $i_1$ and $i_2$ on signal line 39 via an input 31; it stores these magnitudes in RAM 37. The RAM 37 and all other elements of the ARG fault sensor are inter-connected via a Data/Control Bus 32. After smoothing the input magnitudes by averaging each over a suitable time interval, microprocessor 38 infers, for each electromagnet, an actuator force F and a gap g; the microprocessor 38 uses instructions stored in EPROM 35. Then the microprocessor determines whether the force-current pair, for each actuator, lies within the pre-determined acceptable operating envelope, defined by the operating envelope 11 in FIG. 2. It does this by comparing the inferred actuator force (based on the sensed flux density) with the maximum allowed level 500N, by comparing the actual actuator current with the maximum allowed current 10A, and by comparing the inferred gap with the acceptable range of 2–10 mm. The pre-determined acceptable operating envelope is stored in the EEPROM 36.

If, for each actuator, the current-force pair is within the predetermined acceptable operating envelope 11, then the ARG fault sensor ends its program, and waits to rerun the program upon receiving the next set of input magnitudes from the ARG controller. If, however, the current-force pair lies outside the operating envelope 11, then the ARG fault sensor provides a signal on line 39 to command the ARG controller, via an output 33, to shut down.

In the preferred embodiment, besides checking individual gaps, the ARG fault sensor 10 can also check that the average of the two gaps for side-to-side motion is within a predetermined tolerance interval. The pre-determined interval for the average gap is also stored in EEPROM 36.

Figure 4:
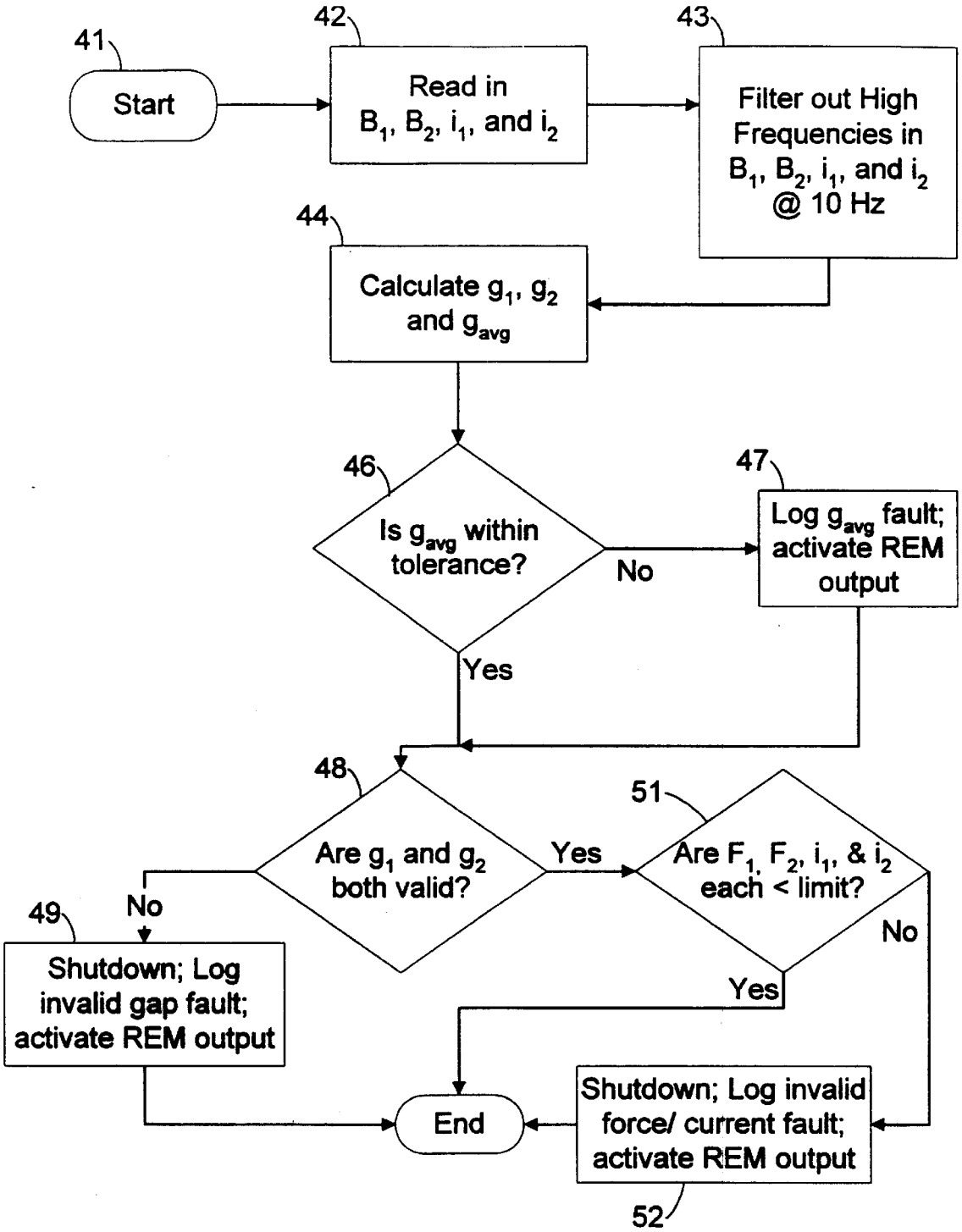
FIG. 4 is a program flow chart for a fault sensor for an ARG, according to the present invention.

Referring now to FIG. 4, a program flow chart for a program that implements the method of the present invention is shown. An entry from the ARG controller 9 into block 41 is performed ten times per second. In block 42, magnitudes of the flux density B and current i for each vibration magnet 23*a* and 23*b* are accumulated in memory. The values of the quantities are then smoothed in the smoothing process 43. Then magnitudes of the gaps for each vibration magnet 23*a* and 23*b* (FIG. 1) as well as the average gap are determined, based on equations (1) and (2) or similar approaches in block 44.

If the average gap is within tolerance, as determined in a step 46, both $g_1$ and $g_2$ are within the acceptable range, and both gaps are within the operating envelope of FIG. 2, as determined in a step 51, the procedure produces no output; it simply restarts. If, however, the average gap is not within tolerance, the procedure makes note, and activates a Remote Elevator Monitoring (REM) output. In this case, even though the average gap may be out of tolerance, if the individual gaps are still both valid (within the acceptable gap boundaries of the operating envelope 11), the procedure may take no further action, depending on what it finds in examining each reported actuator force and current magnitude. As indicated in decision block 48, if, regardless of the magnitude of the average gap, the individual gaps are not each valid, the procedure will send a command to the ARG controller to shut down, will log an invalid gap fault, and activate a REM output, as indicated in a step 49.

If each gap is valid, the ARG fault sensor checks each reported actuator current and force magnitude. Checking the gap magnitudes amounts to checking that the force and current magnitudes are within the curved parts of the boundary 11 of FIG. 2. It is also necessary to check the straight segments of the operating envelope boundary. If the gap magnitudes are all within 2 mm and 10 mm, then as long as the force magnitude is less than the 500-Newton limit, and the current magnitude is less than the 10-ampere limit, the force-current pair is within the operating envelope 11 of FIG. 2, and the procedure is performed again from the start. If the ARG fault sensor finds that a current or force magnitude is greater than its limit magnitude, then it will send to the ARG controller the same shutdown message as it does when it finds that a gap is outside its acceptable range, as indicated in a step 52.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A method of fault-sensing for an elevator active roller guide (ARG) having a current-driven force actuator for positioning an elevator car horizontally within a vertical hoistway, the actuator having a magnet with a coil, the magnet spaced a variable magnitude gap from a reaction bar, the reaction bar connected to a roller on a rail extending along the vertical hoistway, the ARG establishing more or less current in the coil in order to draw the elevator car with more or less force closer to the reaction bar for changing the gap, the ARG including a means for measuring flux density in the gap created by the current, means for signaling the magnitude of current used to drive the actuator, and means for signaling the magnitude of flux density in the gap, the method of fault-sensing comprising the steps of:

a) sensing a signal indicating a new magnitude of current and a signal indicating a new magnitude of flux density;

b) determining from the flux density and the current a magnitude of the gap;

c) comparing the magnitude of the gap to a range defined by a maximum and minimum allowed magnitude of the gap, and providing a signal indicating whether the magnitude of the gap is outside the range; and d) determining if the magnitude of the force and the magnitude of the current are each less than a respective limit, and providing a signal corresponding to the determination.

2. An apparatus for performing the method of fault-sensing as claimed in claim 1, the apparatus comprising:

an input periodically responsive to signals indicating a magnitude of flux density and a magnitude of current for the actuator;

an updatable storage device coupled to the input for storing the magnitudes of flux density and current;

a memory for storing the method of fault sensing, and for storing an acceptable range of gap magnitudes and maximum allowed magnitudes of current and force, the force determined from the flux density; and a signal processor coupled to the updatable storage device and to the memory, that executes the method of fault-sensing stored in the memory, using as data the acceptable range of gap magnitudes and maximum allowed magnitudes of current and force stored in the memory, and the magnitudes of flux density and current stored in the updatable storage device, for providing a signal indicating whether a fault condition exists.

3. An apparatus as claimed in claim 2, wherein the updatable storage device is a random access memory (RAM), wherein the memory is an electrically programmable read-only memory (EPROM), and wherein the signal processor is a microprocessor.

4. An apparatus as claimed in claim 2, wherein the updatable storage device is a random access memory (RAM), wherein the memory consists of two kinds of an electrically programmable read-only memory (EPROM) for storing the fault-sensing method, and an erasable EPROM (EEPROM) for storing the acceptable range of gap magnitudes and maximum allowed magnitudes of current and force, and wherein the signal processor is a microprocessor.

* * * * *